US008022630B2

(12) United States Patent
Chao

(10) Patent No.: US 8,022,630 B2
(45) Date of Patent: Sep. 20, 2011

(54) HIGH INTENSITY DISCHARGE LAMP WITH CORROSION-RESISTANT ELECTRICAL CONNECTOR

(75) Inventor: Chung-Yao Chao, Lincoln, MA (US)

(73) Assignee: OSRAM SYLVANIA Inc., Davers, MA (US)

( * ) Notice: Subject to any disclaimer, the term of this patent is extended or adjusted under 35 U.S.C. 154(b) by 352 days.

(21) Appl. No.: 12/079,016

(22) Filed: Mar. 24, 2008

(65) Prior Publication Data

US 2009/0236986 A1 Sep. 24, 2009

(51) Int. Cl.
*H01J 9/00* (2006.01)
*H01J 17/00* (2006.01)

(52) U.S. Cl. ..... 313/626; 313/567; 313/631; 313/545; 313/552; 445/26; 445/24; 445/1

(58) Field of Classification Search ..... None
See application file for complete search history.

(56) References Cited

U.S. PATENT DOCUMENTS 3,623,134 A * 11/1971 Werner et al. ..... 313/25
3,968,396 A * 7/1976 Clune et al. ..... 315/74
3,996,487 A * 12/1976 Hoeh ..... 313/25
4,020,379 A * 4/1977 Manning ..... 313/600
4,584,454 A * 4/1986 Feuersanger et al. ..... 219/118
4,672,270 A * 6/1987 Ito et al. ..... 315/73
4,737,677 A * 4/1988 Whitten ..... 313/25
6,437,909 B1 * 8/2002 Okamori et al. ..... 359/361
2002/0070644 A1 * 6/2002 Dakin et al. ..... 313/25
2009/0261729 A1 * 10/2009 Bourgery et al. ..... 313/634

* cited by examiner

*Primary Examiner* — Natalie Walford
(74) *Attorney, Agent, or Firm* — Edward S. Podszus

(57) ABSTRACT

An arc discharge lamp (10) has an envelope (12) including a base (14) containing lead-ins (16, 18). An arc tube (20) is positioned within the envelope (12) and has electrodes (22, 24) sealed therein. The electrodes have connection ends (26, 28) extending outside of the arc tube (20). A flexible primary electrical connector (30) is fixed between one of the lead-ins (16) and one of the connection ends (26) of one of the electrodes (22), the flexible primary electrical connector (30) having an area "A" subject to intergranular corrosion in the presence of oxygen and arc tube operating temperatures. A rigid secondary, intergranular-corrosion-resistant electrical connector (32) is electrically connected between the lead-in (16) and the one of the connection ends (26) of the one of the electrodes (22), the rigid secondary electrical connector (32) by-passing the area "A" that is subject to intergranular corrosion.

15 Claims, 1 Drawing Sheet

HIGH INTENSITY DISCHARGE LAMP WITH CORROSION-RESISTANT ELECTRICAL CONNECTOR

TECHNICAL FIELD

This invention relates to lamps and more particularly to high pressure discharge lamps.

BACKGROUND ART

High pressure discharge lamps are efficient sources of light and are adaptable to use in many locations; however, in some locations, where the lamp encompasses higher than normal operating temperatures, failure of the lamp occurs well before its programmed life expectancy. At least one cause of failure derives from breakdown of one of the electrical connections due to a phenomenon known as intergranular corrosion.

DISCLOSURE OF INVENTION

It is, therefore, an object of the invention to obviate the disadvantages of the prior art.

It is another object of the invention to improve high pressure discharge lamps.

It is yet another object of the invention to enhance the operation and life of high pressure discharge lamps.

These objects are accomplished, in one aspect of the invention, by the provision of an arc discharge lamp comprising: an envelope including a base containing lead-ins; an arc tube positioned within the envelope; electrodes sealed into the arc tube, the electrodes having a connection end extending outside of the arc tube; a flexible primary electrical connector fixed between one of the lead-ins and one of the connection ends of one of the electrodes, the flexible primary electrical connector having an area subject to intergranular corrosion in the presence of oxygen and arc tube operating temperatures; and a rigid secondary, intergranular-corrosion-resistant electrical connector electrically connected between the lead-in and the one of the connection ends of the one of the electrodes, the rigid secondary electrical connector by-passing the area subject to intergranular corrosion.

The secondary, intergranular-corrosion-resistant electrical connector maintains current flow in the event of failure of the primary electrical connector, thus allowing the lamp to continue functioning to the end of its programmed life.

BRIEF DESCRIPTION OF THE DRAWINGS

The single FIGURE is a diagrammatic view of an embodiment of the invention.

BEST MODE FOR CARRYING OUT THE INVENTION

Figure 1:
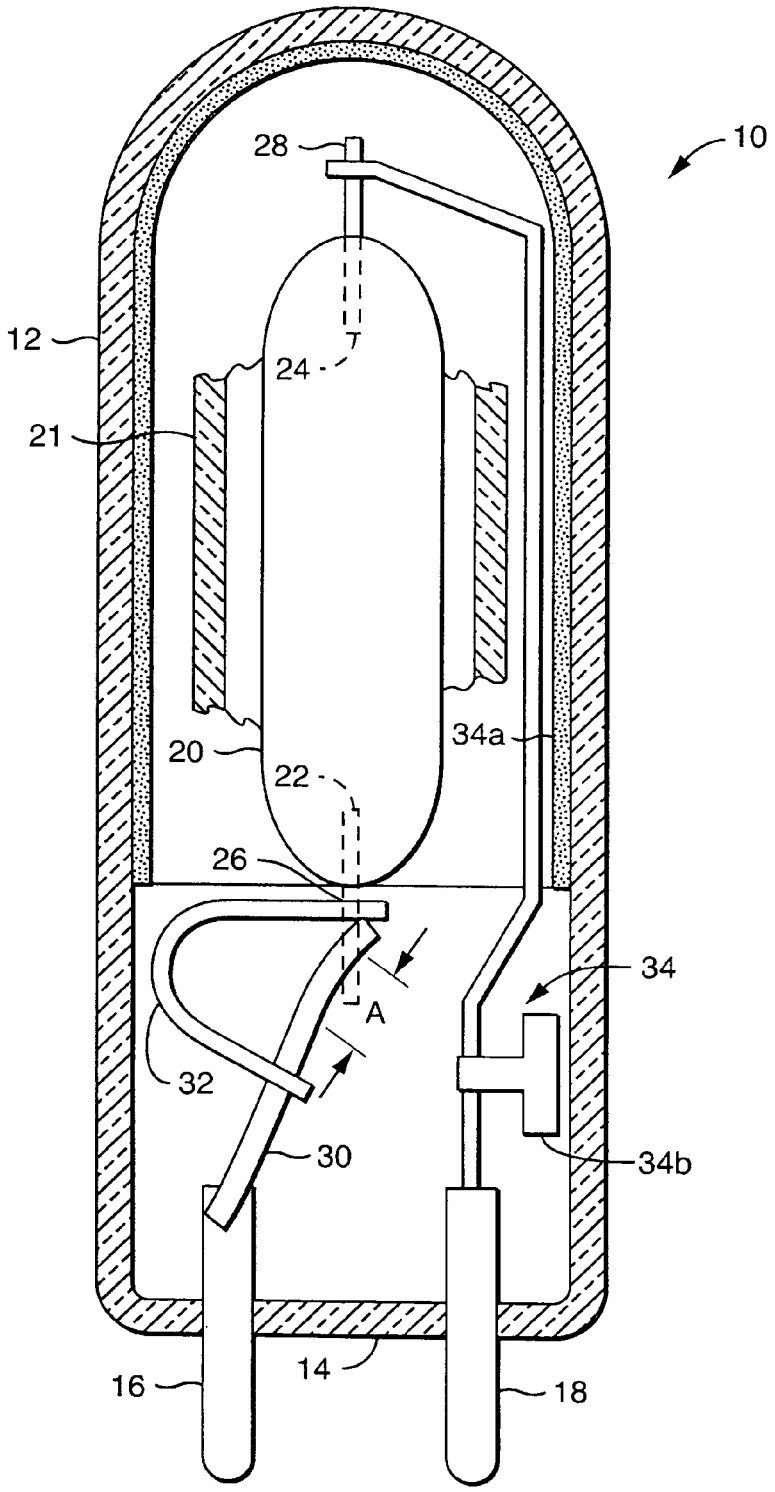

For a better understanding of the present invention, together with other and further objects, advantages and capabilities thereof, reference is made to the following disclosure and appended claims taken in conjunction with the above-described drawings.

Referring now the drawing with greater particularity, there is shown in the single figure an arc discharge lamp 10 comprising an envelope 12 including a base 14 containing lead-ins 16, 18. An arc tube 20 is positioned within the envelope 12 and has electrodes 22, 24 sealed into the ends thereof. The electrodes have connection ends 26, 28 that extend outside of the arc tube 20. The envelope 12 is constructed of a suitable material, such as an aluminosilicate or borosilicate glass and the arc tube 20 is constructed of quartz or a ceramic such as polycrystalline alumina. In some types of protected lamps, a quartz shroud or shield 21 surrounds the arc tube. Such a shield 21 is partially shown in the figure.

A flexible primary electrical connector 30 is fixed between one of the lead-ins 16 and one of the connection ends 26 of one of said electrodes 22. From the nature of the techniques employed in manufacturing the lamp, great flexibility of this connector is required. Further, another requirement is superb current carrying capacity. An ideal candidate material to meet these conditions is a nickel ribbon. However, in the presence of oxygen (and higher than normal temperatures present when the arc tube is operating), the nickel ribbon is subject to a condition known as intergranular corrosion, a condition where the grain boundaries of the nickel are preferentially corroded away leading to failure of the connector and failure of the lamp. As illustrated in the figure, the flexible primary electrical connector 30 is shown as having an area "A" that is subject to this intergranular corrosion in the presence of oxygen and higher than normal operating temperatures. (Higher than normal temperatures can occur when the lamp is operated in a confined area). To solve the problem, a rigid secondary, intergranular-corrosion-resistant electrical connector 32 is electrically connected between the lead-in 16 and the connection end 26 of the electrode 22, the rigid secondary electrical connector 32 by-passing the area "A" that is subject to the intergranular corrosion.

In a preferred embodiment the rigid secondary electrical connector 32 is a nickel-plated steel wire.

Eliminating the oxygen, of course, would also solve the problem; however, there are numerous sources for the unwanted oxygen. A first source 34 could very well be incomplete evacuation of the envelope 12, but other, not so easily avoided sources can also be present. For example, many discharge lamps employ a phosphor coating 34*a* to correct or modify the light output of the lamp and the phosphor can be a source of unwanted oxygen. Other lamps need a hydrogen getter such as shown at 34*b* and these getters, which often comprise $BaO_2$ or $AgO_2$, can also be a source of unwanted oxygen.

Thus there is provided an improved discharge lamp that is far more likely to perform for its intended life span than some of the prior art lamps. The lamp is constructed in the usual manner, for example, by forming an envelope 12 including a base 14 containing lead-ins 16, 18; forming an arc tube 20 and positioning the arc tube 20 within the envelope 12, the arc tube 20 having electrodes 22, 24 sealed therein, the electrodes having connection ends 24, 26 extending outside of the arc tube 20; providing the flexible primary electrical connector 30 fixed between one of the lead-ins 16 and one of the connection ends 26 of one of the electrodes 22, the flexible primary electrical connector 30 having an area "A" subject to intergranular corrosion in the presence of the unavoidable source of oxygen 34 and arc tube operating temperatures; and electrically connecting the rigid secondary electrical connector 32 between the lead-in 16 and the one of the connection ends 26 of the one of the electrodes 22, wherein the rigid secondary, intergranular-corrosion-resistant electrical connector 32 by-passes the area "A" subject to intergranular corrosion.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. An arc discharge lamp comprising:

an envelope including a base containing lead-ins;

an arc tube positioned within said envelope;

electrodes sealed into said arc tube, said electrodes having a connection end extending outside of said arc tube;

a flexible primary electrical connector electrically connected between one of said lead-ins and one of said connection ends of one of said electrodes, said flexible primary electrical connector having an area subject to intergranular corrosion in the presence of oxygen and arc tube operating temperatures; and a rigid secondary, intergranular-corrosion-resistant electrical connector electrically connected between said lead-in and said one of said connection ends of said one of said electrodes, said rigid secondary electrical connector by-passing said area subject to intergranular corrosion.

2. The arc discharge lamp of claim 1 wherein said flexible primary electrical connector comprises a nickel ribbon.

3. The arc discharge lamp of claim 1 wherein said rigid secondary electrical connector comprises a nickel-plated steel wire.

4. An arc discharge lamp comprising:

an envelope including a base containing lead-ins;

an arc tube positioned within said envelope;

an electrode sealed into said arc tube and having a connection end extending outside of said arc tube;

a flexible primary electrical connector electrically connected between one of said lead-ins and said connection end of said electrode, said flexible primary electrical connector having an area subject to intergranular corrosion in the presence of oxygen and arc tube operating temperatures; and a rigid secondary, intergranular-corrosion-resistant electrical connector electrically connected between said lead-in and said connection end, said rigid secondary electrical connector by-passing said area subject to intergranular corrosion.

5. A method of obviating the deleterious effects of intergranular corrosion in an arc discharge lamp containing at least one unavoidable source of oxygen comprising the steps of:

forming an envelope including a base containing lead-ins;

forming an arc tube and positioning said arc tube within said envelope, said arc tube having electrodes sealed therein, said electrodes having a connection end extending outside of said arc tube;

providing a flexible primary electrical connector electrically connected between one of said lead-ins and one of said connection ends of one of said electrodes, said flexible primary electrical connector having, an area subject to intergranular corrosion in the presence of said unavoidable source of oxygen and arc tube operating temperatures; and electrically connecting a rigid secondary, intergranular-corrosion-resistant electrical connector between said lead-in and said one of said connection ends of said one of said electrodes, said rigid secondary electrical connector by-passing said area subject to intergranular corrosion.

6. The method of claim 5 wherein said unavoidable source of oxygen is a phosphor layer.

7. The method of claim 5 wherein said unavoidable source of oxygen is a hydrogen getter.

8. An arc discharge lamp comprising:

an envelope including a base containing lead-ins;

an arc tube positioned within said envelope;

an electrode sealed into said arc tube and having a connection end extending outside of said arc tube;

a flexible primary electrical connector electrically connected between one of said lead-ins and said connection end of said electrode; and a rigid secondary, intergranular-corrosion-resistant electrical connector electrically connected between said lead-in and said connection end, said rigid secondary electrical connector by-passing at least a portion of said flexible primary electrical connector.

9. The arc discharge lamp of claim 1 wherein said flexible primary electrical connector comprises a nickel ribbon and said rigid secondary electrical connector comprises a nickel-plated steel wire.

10. The arc discharge lamp of claim 1 wherein said envelope comprises a material selected from the group of materials consisting of aluminosilicate and borosilicate glass.

11. The arc discharge lamp of claim 1 wherein said envelope comprises a material selected from the group of materials consisting of quartz, ceramic and polycrystalline alumina.

12. The arc discharge lamp of claim 1, wherein said flexible primary electrical connector is in contacting relation with said one of said connection ends of one of said electrodes.

13. The arc discharge lamp of claim 4, wherein said flexible primary electrical connector is in contacting relation with said connection end of said electrode.

14. The arc discharge lamp of claim 5, wherein said flexible primary electrical connector is in contacting relation with said one of said connection ends of one of said electrodes.

15. The arc discharge lamp of claim 8, wherein said flexible primary electrical connector is in contacting relation with said connection end of said electrode.

* * * * *